US008851101B1

(12) United States Patent
Scheland

(10) Patent No.: US 8,851,101 B1
(45) Date of Patent: Oct. 7, 2014

(54) SIPHON MECHANISM

(76) Inventor: Mark Scheland, North Pole, AK (US)

( * ) Notice: Subject to any disclaimer, the term of this patent is extended or adjusted under 35 U.S.C. 154(b) by 169 days.

(21) Appl. No.: 13/442,119

(22) Filed: Apr. 9, 2012

(51) Int. Cl.
*F04F 10/00* (2006.01)

(52) U.S. Cl.
USPC ..... 137/151; 137/146; 137/532; 137/533.17

(58) Field of Classification Search
USPC ..... 137/142–152, 532, 533.17, 533.19
See application file for complete search history.

(56) References Cited

U.S. PATENT DOCUMENTS 330,078 A * 11/1885 Wittram ..... 137/147
342,478 A * 5/1886 Tatum ..... 137/533.11
2,341,129 A * 2/1944 Thompson ..... 137/149
2,755,816 A * 7/1956 Collins ..... 137/496
3,011,510 A * 12/1961 Standifird ..... 137/151
3,083,720 A * 4/1963 Cartwright et al. ..... 137/38
4,286,622 A * 9/1981 Ninomiya et al. ..... 137/533.11
4,290,443 A * 9/1981 Crozzoli ..... 137/147
4,414,997 A * 11/1983 Jacobson et al. ..... 137/151
4,936,846 A * 6/1990 Dureau ..... 623/2.34
4,989,760 A * 2/1991 Songzeng ..... 222/204
5,044,391 A * 9/1991 Brumfield ..... 137/151
6,450,191 B1 * 9/2002 Welch ..... 137/150

* cited by examiner

*Primary Examiner* — John K Fristoe, Jr.
*Assistant Examiner* — Matthew W Jellett
(74) *Attorney, Agent, or Firm* — Michael J. Tavella

(57) ABSTRACT

A siphon initiator that has a drive cylinder and an inner stopper. The stopper is held in a limited range of motion by a wire guard at one end and the formed end of the drive cylinder at the other end. The inner stopper seals the lower end of the drive cylinder during the siphoning. Both ends of the drive cylinder have hose fittings. In practice, after attaching the hoses, the user inserts one hose into the container holding the liquid. The other hose is inserted into the vessel to receive the liquid. The user then moves the drive cylinder back and forth a few times to initiate the flow of fluid. The motion alternatively seals the hose and opens it in rapid succession, causing the necessary vacuum within the draw hose to pull liquid from the container to begin the siphoning process.

1 Claim, 6 Drawing Sheets

SIPHON MECHANISM

CROSS REFERENCE TO RELATED APPLICATIONS

Not Applicable

STATEMENT REGARDING FEDERALLY SPONSORED RESEARCH AND DEVELOPMENT

Not Applicable

BACKGROUND OF THE INVENTION

1. Field of the Invention

This invention relates to siphons and particularly to siphons with moving plugs.

2. Description of the Prior Art

The hydrodynamic principle known as the siphon effect involves the transfer of a liquid by gravity from a source volume of the liquid to a receiving location at a lower elevation using a conduit having a one end immersed below the surface of the source volume, a peak located above the surface of said source volume, and a downstream end located at a level below the first end. As long as the conduit remains liquid-filled, and the hydrostatic head of the downstream arm exceeds the hydrostatic head of the upstream arm, water will flow out of the source volume. The siphon principle provides the advantage of removing water by gravity thus avoiding the need for a pump. The difficulty in establishing a siphon effect is in filling the conduit with the liquid. Several approaches for coping with this problem are disclosed in the prior art.

U.S. Pat. No. 958,415 teaches a simple siphon that uses a simple piston inside of the siphon tube to pull liquid from the contain into the siphon tube. This invention is simple and not useful in larger siphoning operation. U.S. Pat. No. 2,783,715 teaches a siphon that uses a cylinder that attaches to a siphon hose. Inside the cylinder is a piston that has packing at one end and a pyramid shaped plug at the other. This plug is screwed into a retainer. Openings are formed in the retainer structure that divert the liquid around the plug and out of the cylinder. The piston is pulled once or a few times, as needed, to get the flow going. This system is an improvement in that it can be used with longer hoses and larger type suction tubes. The use of the piston, however, still requires a piston with packing and the plug to ensure proper operation. U.S. Pat. No. 3,908,689 teaches another type of piston in a cylinder to initiate siphon flow. This device dispenses with the plug at the bottom of the chamber and replaces it with a system that requires the discharge end of the device be closed as the piston is operating. This is inconvenient if the discharge includes a long hose or is placed in a tank or other container. At best, two people are needed to properly operate such a system, making it inefficient and unproductive. U.S. Pat. No. 4,301,826 teaches yet another piston type siphon that has check valves, seals and packing to make the piston work effectively. U.S. Pat. No. 6,412,528 teaches a bellows type pump to start siphoning. This device also has two check valves as part of the pump portion. U.S. Pat. No. 6,412,528 teaches yet another vacuum type piston pump for siphoning. Unlike the other patents, this device uses a sealed container to draw the vacuum and has the siphon hose adjacent to the pump, rather than being in line with the pump. As in the other cases, this device requires, pumps, seals and check valves to operate. Finally, U.S. Pat. No. 6,926,026 teaches a different type of pump. In this design, there is a cylinder within a cylinder. The inner cylinder is hollow and has a check valve installed in the bottom and a hose fitting below the valve. The outer cylinder has a hose fitting at the top and a check valve under the hose fitting. The user inserts the device in line with hoses and begins the flow by manipulating the outer cylinder-moving it back and forth-to begin fluid flow. Although this device is simpler than the others, it still requires the use of check valves and a seal. Moreover, vigorous pumping of the cylinders might result in the two cylinders separating as there is nothing but the seal to keep the inner cylinder within the outer cylinder. Thus, there is a need for a simple siphoning device that dispenses with seals and check valves and yet quickly and easily begins the flow of liquid though the siphon.

BRIEF DESCRIPTION OF THE INVENTION

The instant invention overcomes these difficulties. It is a siphon initiator that has a drive cylinder and an inner stopper. The inner stopper is movably installed in the drive cylinder so that it can move back and forth. The stopper is held in a limited range of motion by a wire guard at one end and the formed end of the drive cylinder at the other end. The inner stopper is a solid piece that seals the lower end of the drive cylinder when in place. Unlike conventional siphons, such as those described above, this device has only one hose attached to a nipple at the top of the device. The device itself is placed in the vessel to receive the liquid. The user then simply moves the drive cylinder back and forth a few times to initiate the flow of fluid. When the device is moved in a reciprocating motion, the stopper moves back and forth within the drive cylinder. This motion alternatively seals the hose and opens it in rapid succession, causing the necessary vacuum within the draw hose to pull liquid from the container to begin the siphoning process. Once started, the siphoning action will continue as long as desired.

DETAILED DESCRIPTION OF THE INVENTION

Figure 1:
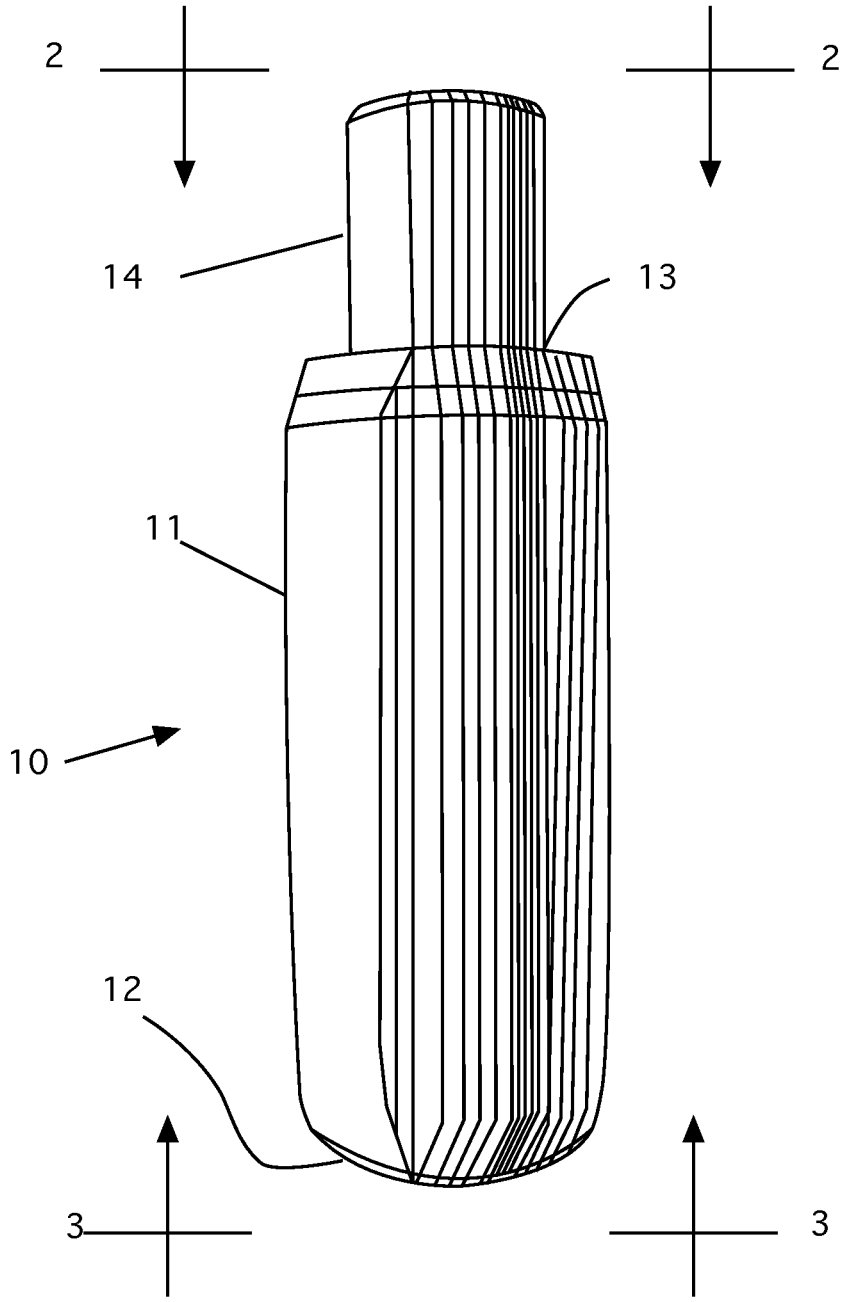
FIG. 1 is a side view of the siphon body.

Referring now to FIG. 1 a side view of the siphon body 10 is shown. The siphon body 10 is the drive mechanism for the siphon operation. It is a generally cylindrical body with a lower portion 11 that has a tapered bottom 12. The top of the lower portion 11 us also slightly tapered and forms a shoulder 13. The top 14 of the siphon body is a nipple that connects to a discharge hose.

Figure 1A:
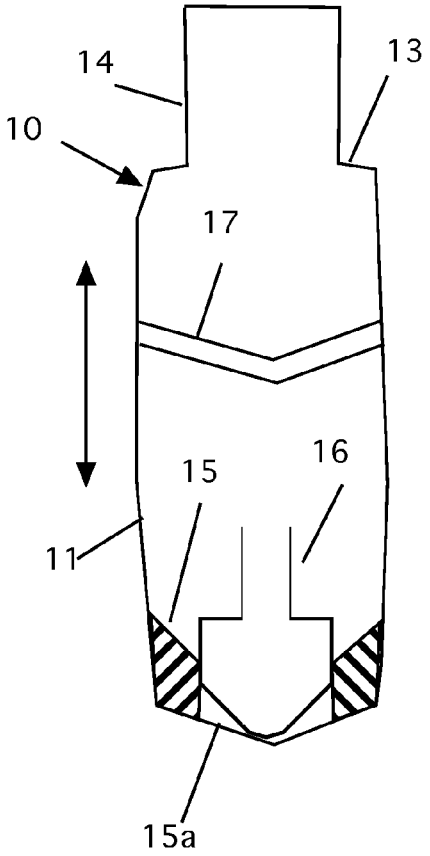
FIG. 1*a* is a cross-sectional view of the siphon body showing the plug in the lowest position.
Figure 1B:
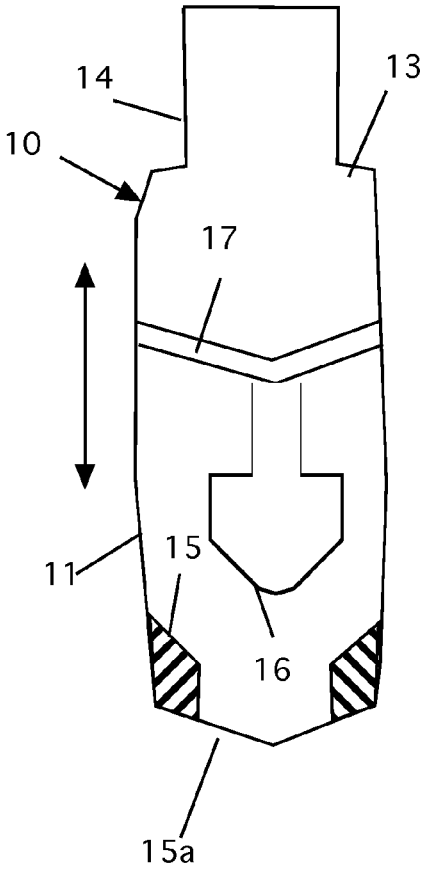
FIG. 1*b* is a cross-sectional view of the siphon body showing the plug in its highest position.

FIG. 1*a* is a cross-sectional view of the siphon body showing the plug in the lowest position. FIG. 1*b* is a cross-sectional view of the siphon body showing the plug in its highest position. These two figures show the interior of the siphon body 10. As noted, the siphon body has a nipple 14 at the top. The bottom 12 of the lower portion 11 of the siphon body forms a shoulder 15 as shown. The shoulder has an opening 15*a* into which a plug 16 sits. The opening 15*a* also acts as an inlet for the siphon. In FIG. 1*a*, the plug 16 is shown in its lowest position, where it seals the outlet 15*a*. FIG. 1*b* shows the plug 16 in it highest position, where it contacts wire 17, which restricts the upward movement of the plug 16. The plug 16 is designed to slide freely within the siphon body. Its use is discussed below. The arrows in these figures indicate the movement of the siphon body when it is used to start a flow.

Figure 2:
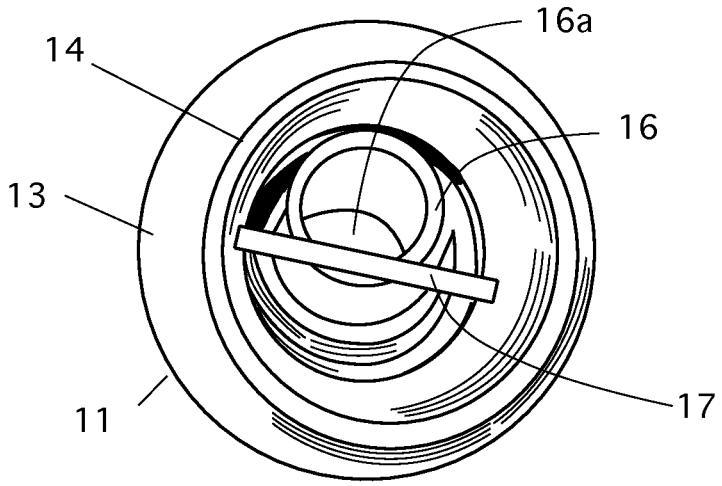
FIG. 2 is a top perspective detail view looking into the siphon body from the top, taken along the lines 2-2 of FIG. 1.

FIG. 2 is a top perspective detail view looking into the siphon body. In this view, the top shoulder 13 of the lower portion 11 is shown. The nipple 14 is shown extending upwardly from it. Liquid being siphoned exits the device through this opening. The wire 17 is shown in place and below that is the plug 16. Note that in this view, the plug 16 is shown at an angle. This is because the plug is free to move within the siphon body. However, the interior space does keep the plug generally upright in use. Note that this view also shows that the plug 16 has a hollowed out portion 16*a*. This is done only to reduce the overall weight of the plug and the operation of the siphon is not affected if the plug 16 is solid.

Figure 3:
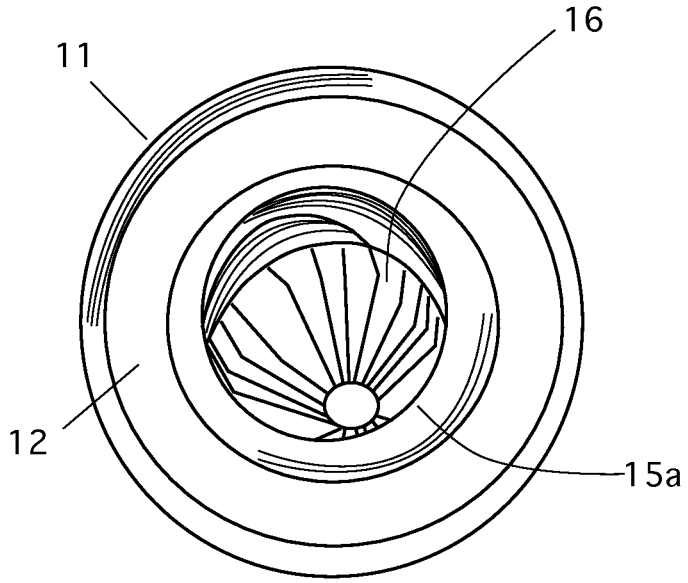
FIG. 3 is a bottom perspective detail view looking into the siphon body from the bottom, taken along the lines 3-3 of FIG. 1.

FIG. 3 is a bottom perspective detail view looking into the siphon body from the bottom. In this view, the bottom of the siphon body is shown. Here, the tapered bottom 12 is shown. In the center is opening 15*a* through which liquid flows when the siphon is in operation. A pick-up hose (see FIG. 5) is normally connected to the siphon body here. Note that this view also shows the bottom of the plug 16. The bottom of the plug 16 is shaped to fit into opening 15*a*, as mentioned above.

Figure 4:
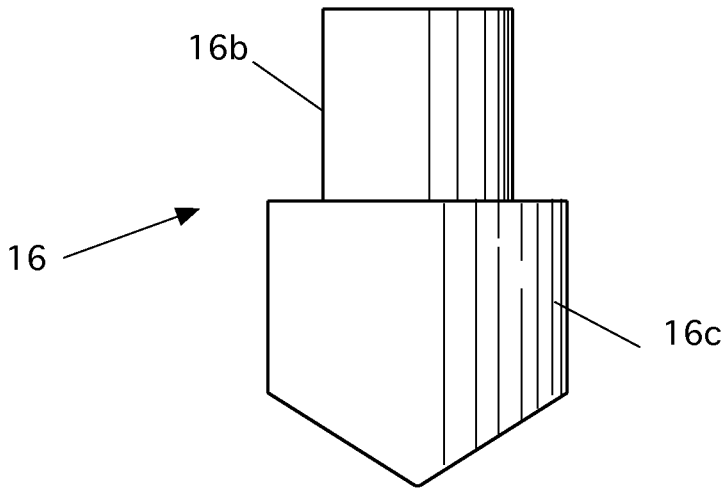
FIG. 4 is a side view of the siphon plug.
Figure 4A:
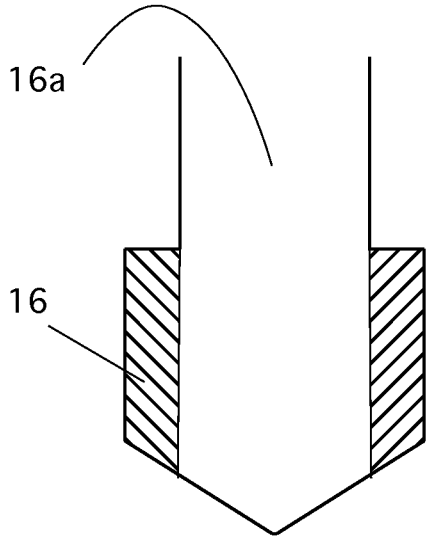
FIG. 4*a* is a cross-section of the siphon plug.

FIG. 4 is a side view of the siphon plug 16. As shown, the plug has an upper portion 16*b* and a lower portion 16*c*. The lower portion 16*c* is shaped to a point. This form allows the plug 16 to fit into the bottom opening 15*a* to seal the opening as part of the beginning of the siphoning process. FIG. 4*a* is a cross-section of the siphon plug. Here, the hollowed interior 16*a* is shown. As mentioned above, this is done solely to reduce the weight of the plug 16.

Figure 5:
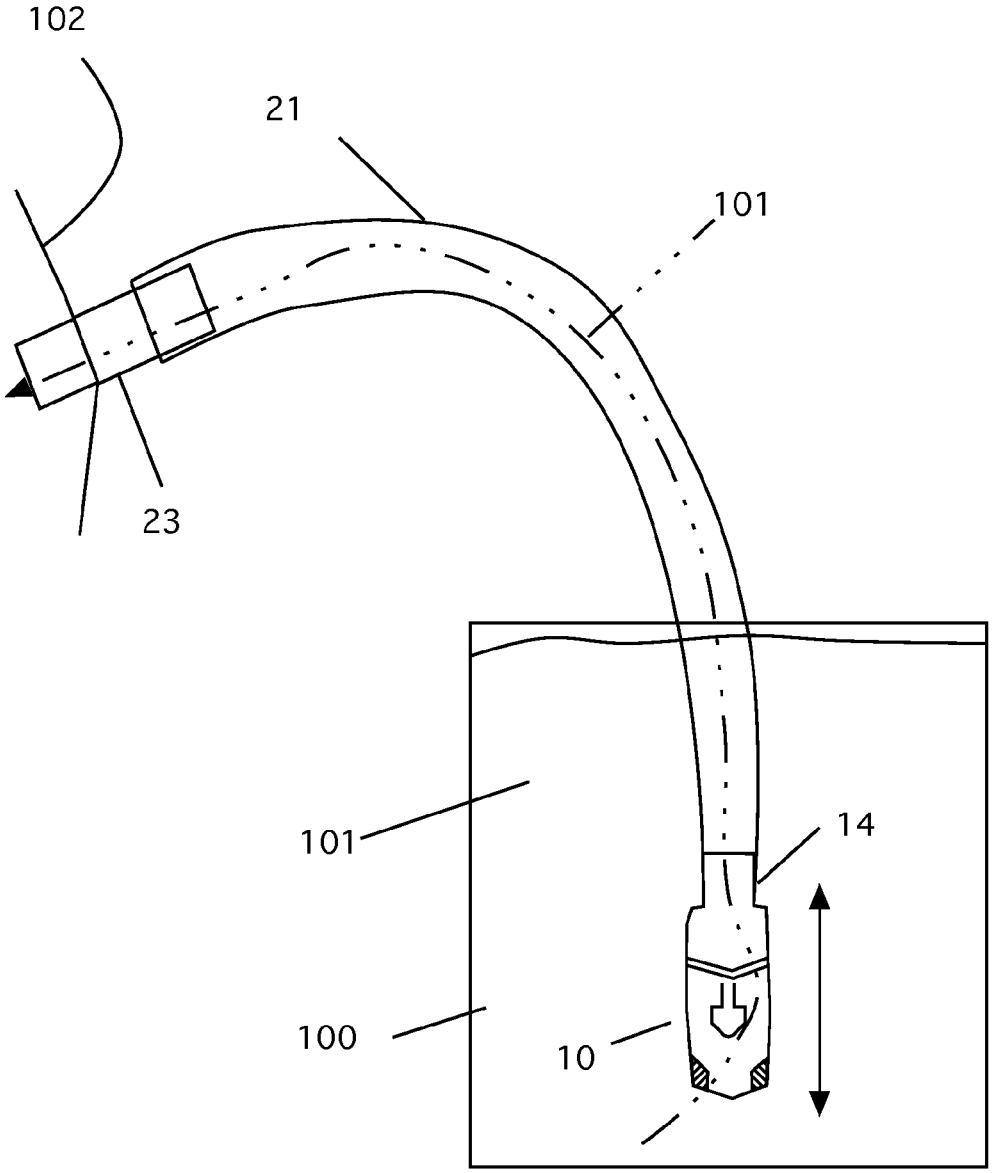
FIG. 5 is a detail view showing a cross-section of the siphon body in the process of siphoning a liquid.

FIG. 5 is a detail view showing a cross-section of the siphon body 10 in the process of siphoning a liquid. In this figure, the siphon body is placed in a container 100. And is completely immersed in the liquid 101. At the top of the siphon body, a discharge hose 21 is attached to the nipple 14. At the other end of the discharge hose is an adaptor 23, discussed below. In this view, the discharge hose is placed into a gas tank fill port 102 of a vehicle, although the discharge can be placed anywhere one desires liquid to be stored. To operate the siphon, the user grips the siphon body with the plug at the lowest position (e.g., FIG. 1*a*) and moves the siphon body in the liquid, so that the plug moves upward until it contacts the wire 17. The user than quickly reverses direction so that the plug falls again to the bottom. The user repeats this movement a few times until the flow of liquid 101 (shown in dashed lines) begins. At that point, the siphon is operation and will continue to operate as long as fluid remains available in the container 100.

Figure 6:
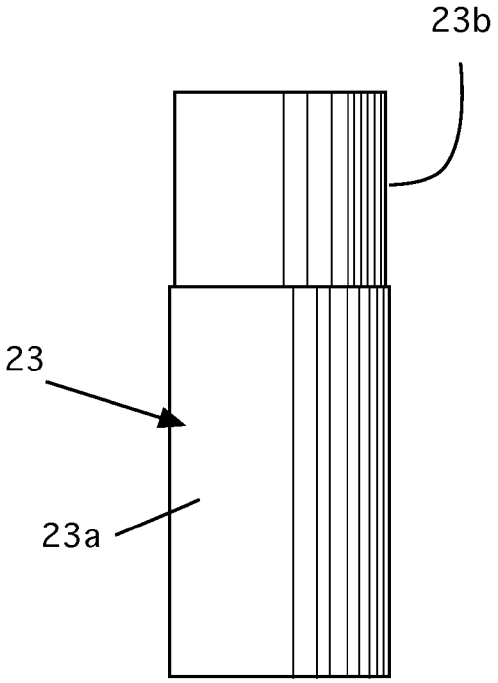
FIG. 6 is a side view of the gas tank adaptor for use with the siphon body.
Figure 7:
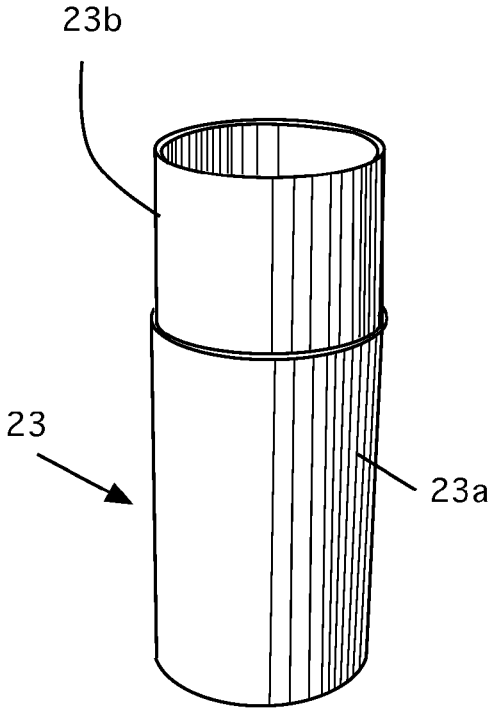
FIG. 7 is a perspective view of the gas tank adaptor.

As noted above, FIG. 5 shows an adapter 23. This adapter is designed to permit the user to use a ¾ inch hose for discharge and still have fuel enter into a gas tank, which today has an opening smaller than ¾-inch. Thus, the adapter 23 has a hose portion 23*a* designed to accept a ¾-inch hose and a tank portion 23*b* sized to fit into a standard modern gas tank opening. FIG. 6 is a side view of the gas tank adaptor 23 for use with the siphon body. FIG. 7 is a perspective view of the gas tank adaptor. 23

The present disclosure should not be construed in any limited sense other than that limited by the scope of the claims having regard to the teachings herein and the prior art being apparent with the preferred form of the invention disclosed herein and which reveals details of structure of a preferred form necessary for a better understanding of the invention and may be subject to change by skilled persons within the scope of the invention without departing from the concept thereof.

I claim:

1. A siphon mechanism comprising:

a) a siphon body having an open top, and open bottom having a cylindrical bore, and an open interior said siphon body having a tapered shoulder formed therein about said open bottom;

b) an outlet hose, removably attached to said open top of said siphon body and extending outwardly therefrom;

c) a plug, slidably installed in said siphon body, such that said plug freely moves therein, said plug having a tapered base, a cylindrical center portion having a diameter, and a neck portion having a diameter smaller than the diameter of the cylindrical center portion, said neck portion extending upwards from said cylindrical center portion, said neck portion further having a uniform circumferential flat top, and further wherein the plug is seated within the cylindrical bore of said open bottom when in a resting position;

d) a single wire stop, positioned within the open interior of said siphon body and extending horizontally across the interior of said siphon body at a place near the top of said siphon body; and e) an adapter, attached to said outlet hose for use with gas tank fill tubes in vehicles, wherein said adapter has an inlet end having a first diameter and an outlet end having a second diameter different in diameter than the first diameter.

* * * * *